US006021849A

United States Patent [19]

Averhoff

[11] Patent Number: 6,021,849

[45] Date of Patent: Feb. 8, 2000

[54] DOUBLE ACTING GAS DISPLACED CHAMBER LIFT SYSTEM AND METHOD

[76] Inventor: Jon R. Averhoff, 600 Rockmead Dr., Suite 200, Houston, Tex. 77339

[21] Appl. No.: 09/201,017

[22] Filed: Nov. 30, 1998

[51] Int. Cl.[7] ..... E21B 43/00; F04B 7/02

[52] U.S. Cl. ..... 166/372; 166/105; 92/38

[58] Field of Search ..... 166/372, 105, 166/105.6; 92/37, 38; 60/370

[56] References Cited

U.S. PATENT DOCUMENTS

| | | | |
|---|---|---|---|
| 2,659,390 | 11/1953 | MacLea, Jr. et al. | 92/37 |
| 3,528,344 | 9/1970 | Rabenhorst | 92/37 |
| 3,617,152 | 11/1971 | Cummings | 417/14 |
| 5,142,412 | 8/1992 | Deschamps et al. | 364/556 |
| 5,542,472 | 8/1996 | Pringle et al. | 166/65.1 |
| 5,806,598 | 9/1998 | Amani | 166/372 |

OTHER PUBLICATIONS

"Otis Single and Dual–Acting Gas Pumps" Brochure Otis Engineering Corp., 1982.

*Primary Examiner*—William Neuder
*Assistant Examiner*—John Kreck
*Attorney, Agent, or Firm*—Harrison & Egbert

[57] ABSTRACT

A double acting artificial lift system for use in a wellbore having two chambers, each having an inlet and outlet; a power gas string connected to both chambers; a liquid string connected to the outlets of both chambers; a vent connected to each chamber for selectively allowing a gas to pass outwardly of the chamber; and a double acting valve connected to the power gas string and the vents. The valve alternately allows the pressurized gas into each chamber, while venting the other chamber. The pressurized gas enters the chambers to cause any liquid in the chambers to pass through the outlet and into the liquid string such that the liquid extends continuously along the entire length of the liquid string. The venting allows the chambers to fill with liquid from the wellbore.

9 Claims, 5 Drawing Sheets

DOUBLE ACTING GAS DISPLACED CHAMBER LIFT SYSTEM AND METHOD

TECHNICAL FIELD

The present invention relates to artificial lift systems. More particularly, the present invention relates to chamber lift systems which are used so as to deliver oil, water and gas from a wellbore to a surface above the wellbore. More particularly, the present invention relates to gas-displaced chamber lift systems.

BACKGROUND ART

At the present time, it is common to permit oil and gas wells to flow under their own natural pressure as long as they will do so and then to apply a mechanical reciprocating pump to complete the removal of the liquids. This method, although in general use, is cumbersome and unsatisfactory. Because suction will only raise oil for a distance of some thirty-five feet, it is necessary to have the pump near the bottom of the well so that it can exert pressure instead of suction on the liquids coming out of the well. This involves the use of pump rods of lengths of 5,000 feet or greater. In many instances when the pump plunger or the valves become worn, it is necessary to remove the pump from that depth to replace the worn parts. Furthermore, the collars on the pump rod wear rapidly and all the pump parts do likewise because of the small particles of grit that remain in the liquid and the whole device is mechanically inefficient because of the relatively long pump rods that must be reciprocated to perform the pumping operation.

When the natural flow of liquid from a well has ceased or becomes too slow for economical production, artificial production methods are employed. In many cases, it is advantageous, at least during the first part of the artificial production period, to employ gas lift. Numerous types of equipment for producing liquid by gas lift are available, but they all rely upon the same general principles of operation. In the usual case, dry gas consisting essentially of methane and ethane is forced down the annulus between the tubing and the casing and into the liquid in the tubing. As the liquid in the tubing becomes mixed with gas, the density of the liquid decreases, and eventually the weight of the column of the gasified liquid in the tubing becomes less than the pressure exerted on the body of liquid in the well, and the flow of liquid occurs at the surface. While, in some cases, the dry gas may be introduced through the tubing so as to cause production through the annulus, this is not preferred unless special conditions are present.

One known gas lift technique injects gas into the casing, which has been sealed or packed off at the bottom of the hole relative to the production tubing. A gas lift valve is placed in the production tubing at the production level, and the gas lift valve permits the gas to be injected into or bubbled very slowly into the liquid being produced from the well. This gas then makes the liquid in the production tube somewhat lighter and, hence, the natural formation pressure will be sufficient to push the liquid up and out of the well. This means that the well can be produced at a greater rate. This gas lift technique is known as continuous gas lift.

A further adaptation of this gas lift technique is known as intermittent gas lift. In this technique, rather than letting the gas enter the production tube slowly, the gas is injected into the production tubing very quickly, in short bursts, thereby forming a large slug of liquid in the production tubing above the injected gas bubble. The gas bubble then drives the slug of liquid in the production tubing upwardly. The technique is repeated successively, thereby producing successive slugs of liquid at the wellhead.

Another type of gas lift tool involves a procedure where a string of production tubing extending from the surface to the zone of interest is provided with a number of gas lift valves positioned at spaced intervals along the length of the tubing. Gas is injected from the annulus between the tubing and the well pipe through the gas lift valves and into the tubing for the purpose of forcing liquid upwardly to the surface and ultimately into a flowline that is connected with the production tubing. Gas lift systems for liquid production are quite expensive due to the cumulative expense of the number of gas lift valves that are ordinarily necessary for each well. Moreover, each of the gas lift valves must be preset for operation at differing pressures because of the vertical spacing thereof within the tubing string and because the valves must function in an interrelated manner to achieve lifting of liquid within the tubing string.

In the past, various patents have issued relating to such gas lift systems. For example, U.S. Pat. No. 5,671,813, issued on Sep. 30, 1997 to P. C. Lima describes a method and apparatus for the intermittent production of oil. In this method, two production strings extend downwardly from a wellhead of an oil well to a point adjacent a producing region. The lower ends of the two production strings are connected by a coupling which allows a mechanical interface launched adjacent the wellhead of one of the production strings to descend along the production string through the coupling and upwardly through the other production string to displace oil from the production strings to a surge tank. High pressure gas is utilized to move the mechanical interface through the production strings and suitable valves are provided for controlling the flow of gas and oil through the production strings.

U.S. Pat. No. 5,562,161, issued on Oct. 8, 1996 to Hisaw et al. describes a method of accelerating production from a well. This method includes the steps of installing a venturi device within the well. A gas is injected within the annulus and introduced into the well. The venturi device creates a zone of low pressure within the well as well as accelerating the velocity of the production fluid so that the inflow from the reservoir is increased.

U.S. Pat. No. 5,407,010, issued on Apr. 18, 1995 to M. D. Herschberger teaches an artificial lift system and method for lifting fluids from an underground formation. This artificial lift system includes a production tubing through which the fluid is carried from the formation to the surface and a pressure reducer, such as a venturi, connected to the production tubing to artificially raise the level of the fluid in the production tubing above the static level associated with the head pressure of the fluid in the formation.

U.S. Pat. No. 5,217,067, issued on Jun. 8, 1993 to Landry et al. describes an apparatus for increasing flow in an oil well which includes an injection valve so as to enable gas to be injected and to cause the oil or other liquid within the well to be lifted to the surface. The valve has a valve body having an inlet at one end and an outlet at the other end which are adapted to be fitted into conventional production oil tubing. A gas injection port opens into the outlet of the valve body and there is at least one gas inlet opening in a side of the valve body. This gas inlet opening is connected to the gas injection port. This enables compressed gas to be sent down the well between the casing and the tubing and injected through the gas injection port and into the flow of oil.

U.S. Pat. No. 5,211,242, issued on May 18, 1993 to Coleman et al. describes a chamber in a well which is connected to two externally separate tubing strings to unload liquid which is applying backpressure against a formation so that the production of fluid from the formation is obstructed. Volumes of the liquid are intermittently collected in the chamber and lifted out of the well through one of the tubing strings in response to high pressure gas injected solely into the chamber through the other tubing string.

U.S. Pat. No. 4,708,595, issued on Nov. 24, 1987 to Maloney et al. describes an intermittent gas-lift apparatus and process of lifting liquids. This apparatus includes a chamber on the downhole end of a production tubing in communication with a sidestring tube. The sidestring tube is in communication with the high pressure gas stored within the casing and above and below a packer. A valve in the sidestring tube permits the entrance of a lifting gas into the chamber to lift the liquids flowing therein to the surface. A surface bleed-down system minimizes the pressure in the production tubing. This increases the pressure differential between the formation and the interior of the casing and lifting chamber during the operation of the apparatus.

German Patent No. 23 64 737, published on Jul. 10, 1975, teaches a compressed air lift pump for deep wells in which the pump has a number of stages one above the other. Liquid is raised by air from the reservoir of one stage to the reservoir of the next. Each stage has two air supply pipes which contain three-way valves operated by an electronic timer to admit and release air alternately.

Soviet Patent No. 1204-700-A teaches an intermittent gas lift system for a pump well which includes a tubing, a packer, a substitution chamber and intake valve, lift starter valves and working valves with a seal and a seat over a space connected to the chamber. The rising level of fluid in the chamber raises the float so as to close off ports and thus raise pressure above the diaphragm so as to clear the valve and transfer gas to the chamber. This gas forces the fluid into the tubing and uses a pressure gradient to hold the ports closed. Gas eventually enters the tubing after all fluid has been expelled, thus opening the two ports by lowering the float back down. Gas is removed entirely from the chamber by the incoming fluid.

Soviet Patent No. 570697 teaches an oil production facility including a displacement chamber, two strings of compressor pipes of which one is coupled to the surface drive. The gas from the chamber is recuperated and expanded. When one vessel is empty, fluid is drawn into the displacement chamber. The second vessel pumps oil over into the empty vessel so as to raise its pressure to the point required to drive the hole fluid over into the lifting string to the surface. Once the fluid in the chamber reaches the bottom of the lift string, the motor reverses so as to turn an electric shaft and compress the gas in the first vessel to repeat the process in a second hole.

A major problem with the aforedescribed artificial lift systems is that they do not work effectively in deep well and sour gas environments. In particular, at depths of greater than 10,000 feet, the temperature range encountered can be approximately 300 degrees Fahrenheit. As such, any mechanical pumping apparatus will not work effectively at such temperatures. At such great depths, the rod pump devices and submersible pump apparatus do not effectively deliver oil and gas to the surface. For example, at such great depths, the pump rod will have an extreme length which cannot be easily reciprocated back and forth. Furthermore, the cost associated with such a lengthy pump rod would not allow for efficient production. The high temperature and pressures encountered at such depth cause submersible pumps and hydraulic pumps to fail quickly.

In those systems in which the intermittent production of "slugs" of oil is utilized, such systems are ineffective at such depths. In each case in which a "slug" of oil is produced, the gas must be relied upon so as to deliver such a slug to the surface. At great depths, this can take a great deal of time so as to produce an economical amount of oil. Furthermore, the pressure and energy required so as to push such a slug to the surface may exceed the value of the actual production.

Production at such a depth is further complicated by situations in which a corrosive sour gas is encountered. This is particularly true in those cases in which oil and gas must be removed from Smackover wells.

It is an object of the present invention to provide an artificial lift system which works effectively at depths of greater than 10,000 feet.

It is a further object of the present invention to provide an artificial lift system which can operate in a high temperature environment at the bottom of the well.

It is another object of the present invention to provide an artificial lift system in which production from the liquid string occurs continuously without the need for transporting a "slug" of oil to the surface.

It is another object of the present invention to provide an artificial lift system which works effectively in highly corrosive sour gas environments.

It is another object of the present invention to provide an artificial lift system which can lift liquid volumes of approximately 500 barrels per day.

It is a further object of the present invention to provide an artificial lift system which can operate in a very "gassy"/high API oil gravity environment.

It is still a further object of the present invention to provide an artificial lift system which can handle saturated brines of greater than 200,000 parts per million.

The foregoing objects and advantages of the present invention will become apparent from a reading of the attached specification and appended claims.

SUMMARY OF THE INVENTION

The present invention is an artificial lift system for use in a wellbore comprising: a chamber having an inlet and an outlet; a power gas string connected to the chamber; a liquid string connected to the outlet of the chamber, a vent connected to the chamber for selectively allowing a gas to be passed outwardly of the chamber, a compressor connected to the power gas string for passing a pressurized gas into the power gas string, and a valve connected to the power gas string and to the chamber. The valve selectively allows the pressurized gas to enter the chamber so as to cause any liquid in the chamber to pass through the outlet and into the liquid string such that the liquid extends as a continuous line along the length of the liquid string.

In the present invention, the valve selectively blocks the flow of pressurized gas into the chamber. The valve is movable between a first position which allows the pressurized gas into the chamber and a second position which blocks pressurized gas from entering the chamber. The valve is movable between the first and second positions relative to a pressure of the gas in the power gas string.

In the present invention, the chamber includes a one way inlet valve connected thereto. This inlet valve allows liquid to pass from the wellbore into the chamber. The outlet of the chamber also has a one way valve thereon. The one way valve on the outlet of the chamber allows liquid from within the chamber to pass into the liquid string.

In the present invention, the vent is interactive with the valve such that the vent allows gas to vent from the chamber when the valve is in the second position. The wellbore has perforations or other openings formed therein so as to allow liquids and gases from a subsurface earth formation to enter the wellbore. The vent includes a vent stack which extends from the chamber so as to have an outlet above the perforations. The chamber can be positioned above or below the perforations in the wellbore.

Preferably, in the present invention, the power gas string and the liquid string are formed of coiled tubing. This coiled tubing can be siamese strings which are connected to the chamber.

In the present invention, the compressor serves to pass pressurized gas of greater than 5,000 p.s.i. into the power gas string.

In one form of the present invention, the chamber includes a first chamber having an inlet and an outlet and a second chamber having an inlet and an outlet. The outlet of the first chamber is in valved connection to the liquid string. This valve connects the power gas string to the first chamber such that the valve selectively passes pressurized gas from the power gas string into the first chamber. The outlet of the second chamber is also in valved connection to the liquid string. The valve connects the power gas string to the second chamber such that the valve selectively passes the pressurized gas from the power gas string into the second chamber. As a result, the flow of liquids from each of the chambers can be alternated so that more continuous and even delivery of the liquid to the liquid string is achieved. Furthermore, each of the chambers allows for the accumulation of fluids therein during the period of time in which the other chamber is evacuated of such fluids. In one form of the invention, the first chamber is positioned interior of the second chamber. In another form of the invention, the first chamber is in stacked relation to the second chamber. The valve is movable between a first position in which the valve passes the pressurized gas into the first chamber while blocking gas flow into the second chamber and a second position in which the valve passes the pressurized gas into the second chamber while blocking gas flow into the first chamber. The vent is interactive with the valve so as to vent gas from the first chamber when the valve is in the second position and for venting gas from the second chamber when the valve is in the first position.

The present invention is also a method of lifting a fluid from a wellbore which comprises the steps of: (1) placing a chamber into the wellbore and having an inlet so as to allow a fluid from the wellbore to enter the chamber; (2) extending a liquid string from the chamber; (3) extending a power gas string to the chamber; (4) passing pressurized gas through the power gas string to the chamber so as to force the fluid from the chamber and into the liquid string; (5) blocking gas flow from entering the chamber when a desired amount of fluid has entered the liquid string; (6) venting gas from the chamber as the fluid fills the chamber; and (7) passing pressurized gas into the chamber and blocking the venting of gas so as to cause the fluid to exit the chamber and into the liquid string in a continuous liquid line through the liquid string.

DETAILED DESCRIPTION OF THE PRESENT INVENTION

Figure 1:
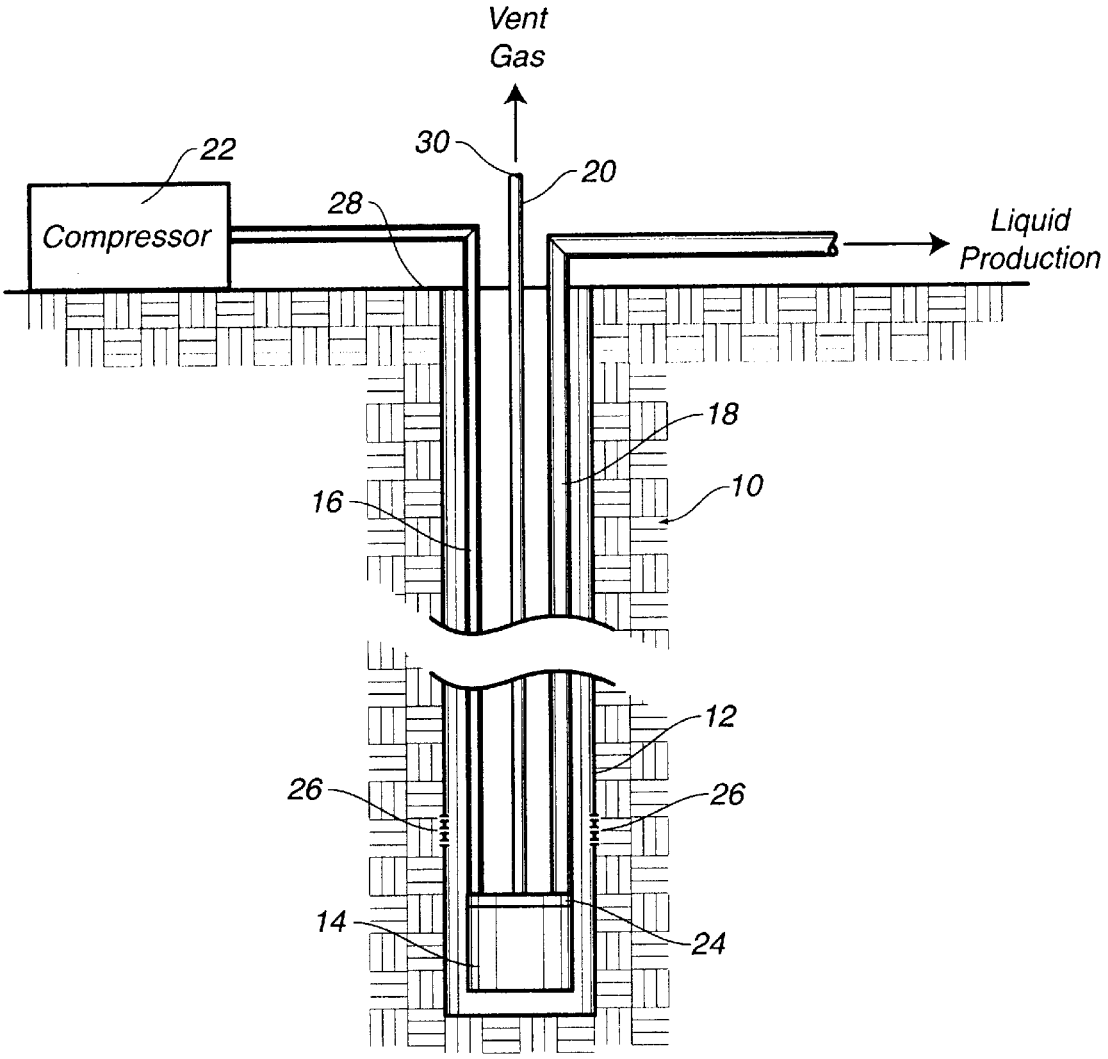
FIG. 1 is a diagrammatic cross-sectional view showing the configuration of the artificial lift system of the present invention.

Referring to FIG. 1, there is shown at 10 the artificial lift system in accordance with the teachings of the present invention. The artificial lift system 10 is used for the extraction of oil, water and gas from the wellbore 12. The artificial lift system 10 includes a chamber 14, a power gas string 16, a liquid string 18, a vent stack 20 and a compressor 22. A suitable valving mechanism 24 is provided in association with the chamber 14. The valving mechanism 24 will be described in greater detail in connection with the illustrations of FIGS. 2–5.

As can be seen in FIG. 1, the chamber 14 is located in the wellbore 12 below perforations 26 that are formed in the wellbore 12. The chamber 14 could also be positioned above the perforations in the wellbore. The perforations 26 can be associated with perforations that are formed in an existing casing or in an existing production tubing. The power gas string 16 will extend from the compressor 22 to the chamber 14. The valving mechanism 24 is interactively connected with the power gas string 16 so as to allow pressurized gas to enter the chamber and to cause any liquid in the chamber 14 to pass through an outlet in the chamber and into the liquid string 18. Any liquids within the chamber 14 will enter the liquid string 18 in a continuous flow line along the liquid string 18. The liquid string 18 extends from the chamber 14 to the wellhead area 28. As such, liquid, such as oil, can be removed from the wellbore 12. Vent stack 20 is illustrated as extending from the chamber 14. The vent stack should have a suitable height so that the outlet 30 of the vent stack 20 resides in a location above the perforations 26. The vent stack 20 does not have to extend to an above-earth location, as illustrated in FIG. 1.

In FIG. 1, the compressor 22 should be a compressor which can produce at least 5,000 p.s.i. of gas pressure. This relatively large amount of gas pressure is required so as to push the entire line of liquid from the chamber 14 in a continuous line through the liquid string 18. The valving mechanisms and the associated tubing should have a suitable integrity to withstand such pressure.

Importantly, in the present invention, the power gas string 16 and the liquid string 18 can be formed of coiled tubing. Such coiled tubing can be run in and pulled from the well together as siamese strings. This provides an enormous efficiency in the installation and removal of such power gas and liquid strings.

Figure 2:
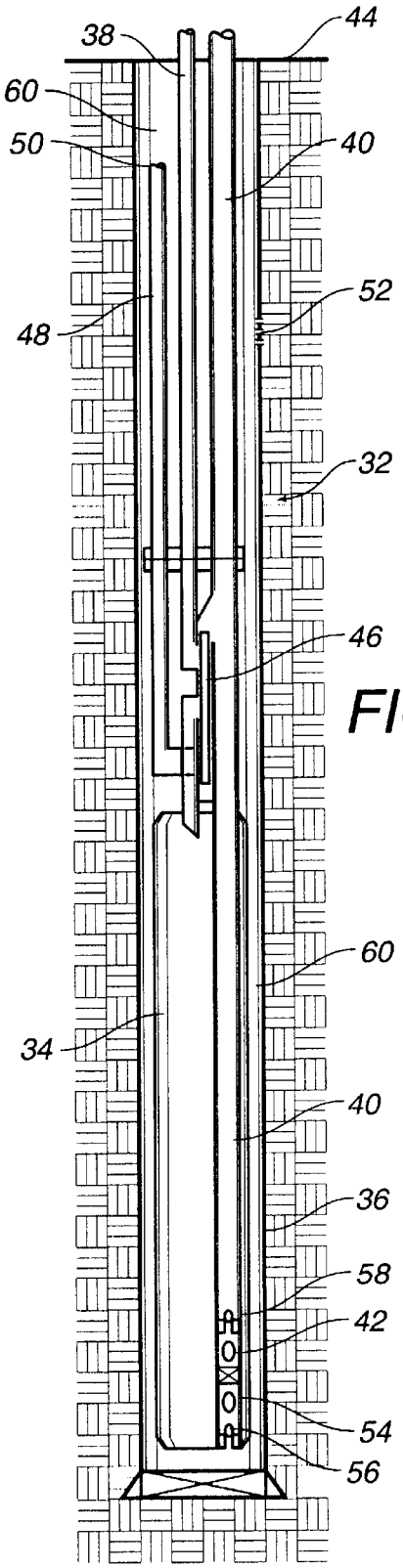
FIG. 2 is a diagrammatic illustration of the single chamber gas displaced chamber lift system of the present invention.

Referring to FIG. 2, there is illustrated a simplified form of the present invention which is a single chamber gas displaced chamber lift system 32. In this form of the present invention, a chamber 34 is placed within the wellbore 36. A power gas string 38 extends through the wellbore 36 and communicates, in valved communication, with the interior of the chamber 34. A liquid string 40 is connected to an outlet 42 of the chamber 34. The liquid string 40 will extend through the wellbore 36 and exit at the wellhead 44. A shifting valve 46 is provided so as to control the interaction of the chamber 34 with the power gas string 38 and with the vent stack 48. As can be seen in FIG. 2, the vent stack 48 is a tubing which extends so as to have an outlet 50 located above the perforations 52 in the wellbore 36. The valve 46 is a shifting valve in a side pocket mandrel with a side string connection. A valve 46 serves to shift the power gas so as to deliver the power gas into the interior of the chamber 34 when the pressure in the power gas string reaches an upper level. The shifting valve 46 serves to block the delivery of power gas from the power gas string 38 to the chamber 34 and to open the vent stack 48 when the pressure in the power gas string 38 reaches a lower level. The monitoring of the pressure in the power gas string 38 and the operation of the valve 46 can be carried out with suitable sensors and actuators.

As can be seen in FIG. 2, the chamber 34 includes an inlet 54 which allows fluids from the subsurface earth formation to enter the interior of chamber 34. The inlet 54 includes a one-way check valve 56 which is configured so that the fluids will flow into the interior of chamber 34 but will not exit the interior of chamber 34 through the valve 56. Any flow of liquid into the interior of chamber 34 will displace the ball associated with check valve 56. When the pressurized gas enters the interior of the chamber 34, the ball of the check valve 56 will move to its seated location so as to prevent any loss of fluids through the inlet 54.

The outlet 42 also includes a check valve 58. The outlet 42 will allow any fluids on the interior of chamber 34 to exit the chamber 34 when the power gas is delivered from the power gas string 38 into the interior of chamber 34. The power gas will force the fluid from the interior of chamber 34 through the outlet 42, through the check valve 58 and into the liquid string 40. This flow will displace the ball of check valve 58 during the exiting of fluid from the chamber 34. The ball of check valve 58 will become seated when the flow of pressurized gas is blocked from entering the chamber 34. The weight of the liquid column within the liquid string 40 will force the ball of check valve 58 into its seated relationship therewith and to prevent the liquid from reentering the chamber 34.

In operation, the method of the present invention begins with the chamber 34 being full of liquid. The valve 46 communicates with the top of the chamber 34 with the casing annulus 60 at a point above the perforations 52. Simultaneous with this, the compressor 22 at the surface is injecting gas into the power gas string 38. The gas injected in the power gas string 38 increases the pressure in the power gas string since the shifting valve 46 has the power gas string 38 blocked downhole.

At a calculated preset power gas string pressure, the shifting valve 46 closes the port of the vent stack 48 and opens the top of the chamber 34 to the power gas string 38. In this case, the switching occurs when the power gas string pressure at the shifting valve 46 increases to an upper level of pressure. This upper pressure setting is calculated such that the power gas string 38 will "store" the correct volume of power gas to displace the interior of the chamber 34. The power gas begins to enter the chamber 34 and push ("displace") the liquid out of the chamber 34. The inlet check valve 56 closes and prevents the liquid from flowing back to the casing annulus 60. The liquid travels through the outlet check valve 58 and into the liquid string 40. During this process, gas is moving out of the power gas string 38 faster than the compressor 22 is replacing it. As a result, the power gas string pressure begins to drop. The power gas continues to displace liquids out of the chamber 34 and into the liquid string 40. When the power gas pressure declines to a calculated preset pressure, the shifting valve 46 closes the power gas string port and communicates the chamber with the annulus 60 of the casing 36. This occurs when the power gas pressure at the chamber declines to its lower level. The volume of gas taken out of the power gas string 38 so as to reduce the pressure to this lower level, while the compressor 22 is injecting gas into the power gas string 38, is the volume required to displace the liquid from the chamber 34 into the liquid string 40. This is the volume of gas to occupy the space previously occupied by the liquid. In this application, approximately 1,500 SCF of gas occupies one barrel of volume at downhole conditions (5,700 psi and 300 degrees F). With the port of the power gas string 38 closed and the venting port open, liquid displacement from the chamber 34 stops and the outlet check valve 58 closes so as to trap the liquid in the liquid string 40.

Following this step, the venting and depressurizing of the chamber 34 to the casing annulus 60 occurs. When the pressure of the chamber 34 declines to the hydrostatic pressure created by the column of liquid in the casing annulus at the chamber intake 54, the inlet check valve 56 opens and the chamber 34 begins to fill with liquid. The chamber is now simultaneously being depressurized and filled with liquid. This process continues until (1) the chamber 34 is filled completely with liquid or (2) the shifting valve 46 closes the vent port and opens the port to the power gas string 38. The latter is controlled by the rate at which gas is being injected into the power gas string 38. Therefore, it is important that the time required to depressurize and refill the chamber 34 is the same as the time to raise the pressure in the power gas string 38 from its lower level to its higher level. The cycle then repeats itself.

Figure 3:
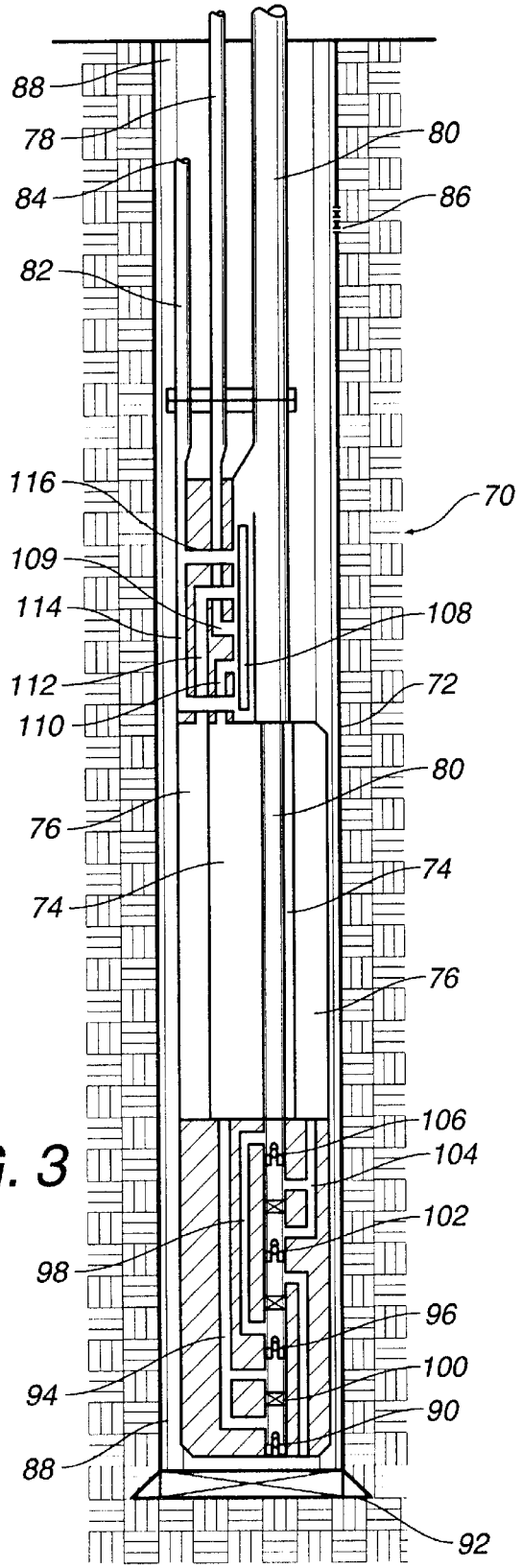
FIG. 3 is a cross-sectional view illustrating one embodiment of the double chamber gas displaced chamber lift system of the present invention.

FIG. 3 shows an alternative embodiment 70 of the artificial lift system of the present invention. Artificial lift system 70 is located within a wellbore 72. In this embodiment of the present invention, a first chamber 74 is positioned on the interior of a second chamber 76. A power gas string 78 is arranged so as to be in valved communication with each of the chambers 74 and 76. A liquid string 80 also extends so as to be in valved connection with each of the chambers 74 and 76. A vent stack 82 is further connected in valved communication with the chambers 74 and 76. The outlet 84 of the vent stack 82 is located above the perforations 86 in the casing of the wellbore 72. As such, the vent 82 is suitable for venting to the annulus 88 of the wellbore.

Initially, an inlet check valve 90 is provided adjacent to the bottom of the system 70 adjacent to the bottom packing 92. The inlet check valve 90 allows any fluids in the annulus 82 to pass through passageway 94 and into the interior of the first chamber 74. During the injection of pressurized gas into the first chamber 74, any liquids on the interior of the chamber 74 also will pass through passageway 94 and exit into the liquid string 80 through the outlet check valve 96 and through passageway 98. Passageway 98 is connected to the liquid string 80. Similarly, liquids from the annulus 88 can enter the second chamber 76 through an inlet passageway 100. Inlet passageway 100 leads to an inlet check valve 102. As such, liquids will pass through the check valve 102 and through a passageway 104 to the interior of the second chamber 76. Upon the introduction of pressurized gas into the interior of the second chamber 76, the liquids will exit the chamber 76 through the passageway 104 and through an outlet check valve 106 into the interior of the liquid string 80.

Shifting valve 108 is provided so as to have a similar action as that described herein previously. Shifting valve 108 has two positions. When shifting valve 108 is in the first position it connects passageway 109 with passageway 110 which causes the power gas string 78 to be communicated only with chamber 74. In this same position, passageway 114 is blocked from passageway 110. As such, chamber 74 is not communicated with vent stack 82. While shifting valve 108 is in the first position, it also connects passageway 112 with passageway 116 which causes the vent stack 82 to be communicated only with chamber 76. In this position, passageway 109 is blocked from passageway 112. As a result, chamber 76 is not communicated with the power gas string 78. When shifting valve 108 is in the first position, power gas will displace any liquids from chamber 74 into liquid string 80 and chamber 76 will depressure through vent stack 82 and fill with liquid from annulus 88. When shifting valve 108 switches to its second position, the connections are reversed. That is, chamber 74 is communicating with vent stack 82 through passageways 110 and 114. Chamber 76 is communicating with the power gas string 78 through passageways 112 and 109. As such, the present invention can achieve simultaneous displacement of one chamber while the other chamber is being depressurized and refilled. This double chamber configuration can lift twice as much liquid as a single chamber arrangement.

Figure 4:
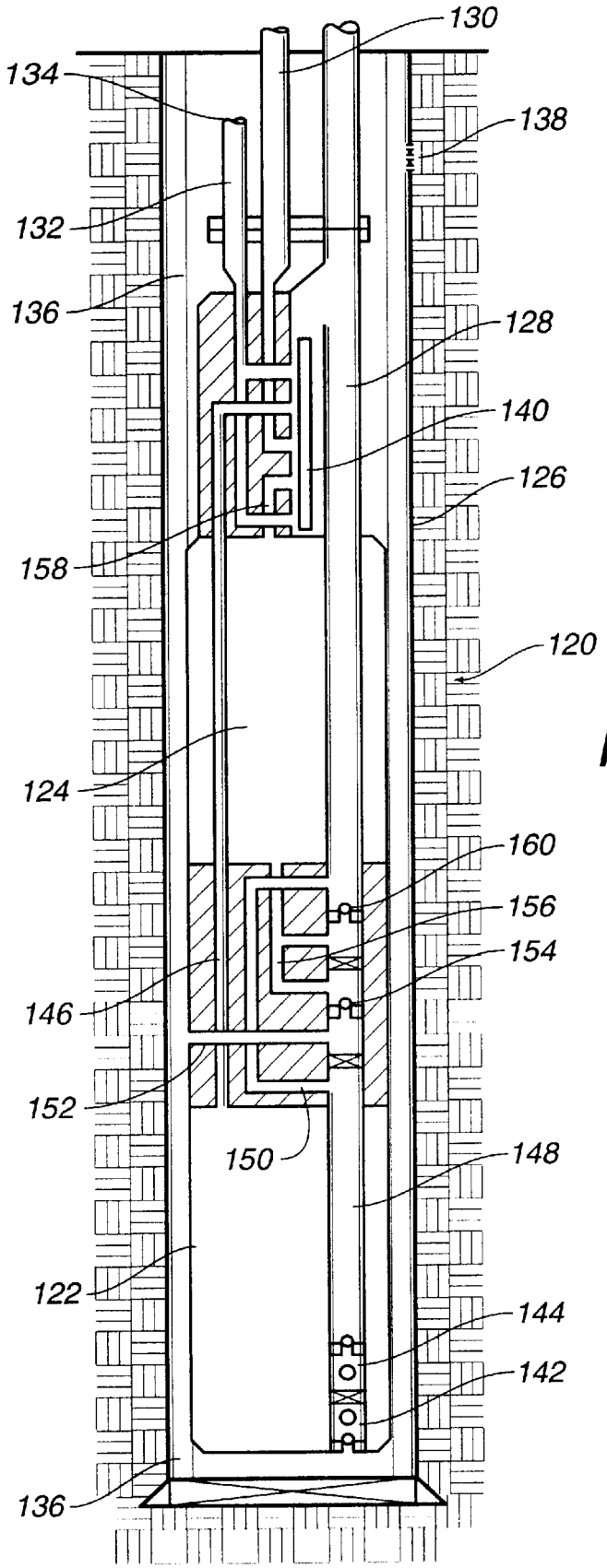
FIG. 4 is a cross-sectional view of a second alternative embodiment of the double chamber gas displaced chamber lift system of the present invention.

FIG. 4 shows another alternative embodiment 120 of the dual chamber artificial lift system of the present invention. The artificial lift system 120 includes a first chamber 122 and a second chamber 124 arranged in a stacked configuration within the wellbore 126. A liquid string 128 is in valved communication with each of the chambers 122 and 124. Similarly, a power gas string 130 is valved communication with each of the chambers 122 and 124. A vent stack 132 has an outlet 134 located within the annulus 136 above the perforations 138 in the wellbore casing. A shifting valve 140 serves to allow for the filling and evacuation of the respective chambers by shifting so as to expose certain passageways such that pressurized gas from the power gas string 130 is blocked or allowed to flow into the respective chambers.

In FIG. 4, it can be seen that the first chamber 122 has an inlet valve 142 and an outlet valve 144. Inlet valve 142 allows fluids from within the annulus 136 to enter the interior of the first chamber 122. Pressurized gas can be introduced into the chamber 122 through passageway 146. When the shifting valve 140 is opened, the pressurized gas will flow through passageway 146 and into the chamber 122 so as to cause liquids to flow through valve 144 and into a bottom portion 148 of the liquid string 128. The liquid will flow through a passageway 150 so as to emerge into the liquid string 128.

The second chamber 124 allows the liquid to enter the interior of chamber 124 through an inlet passageway 152. Inlet passageway 152 allows fluid from the annulus 136 to enter the interior of the chamber through inlet valve 154 and through passageway 156. When pressurized gas is introduced into the interior of the second chamber 124 through passageway 158, any liquids on the interior of chamber 124 will flow through passageway 156, through valve 160 and into the liquid string 128. The shifting valve 140 also allows venting from each of the chambers in the manner described herein previously. This stacked arrangement of chambers 122 and 124 is an alternate to the embodiment shown in FIG. 3 and should allow for the lift of twice as much liquid as the single chamber model. Simultaneous displacement of one chamber occurs while the other chamber is being depressurized and refilled.

Figure 5:
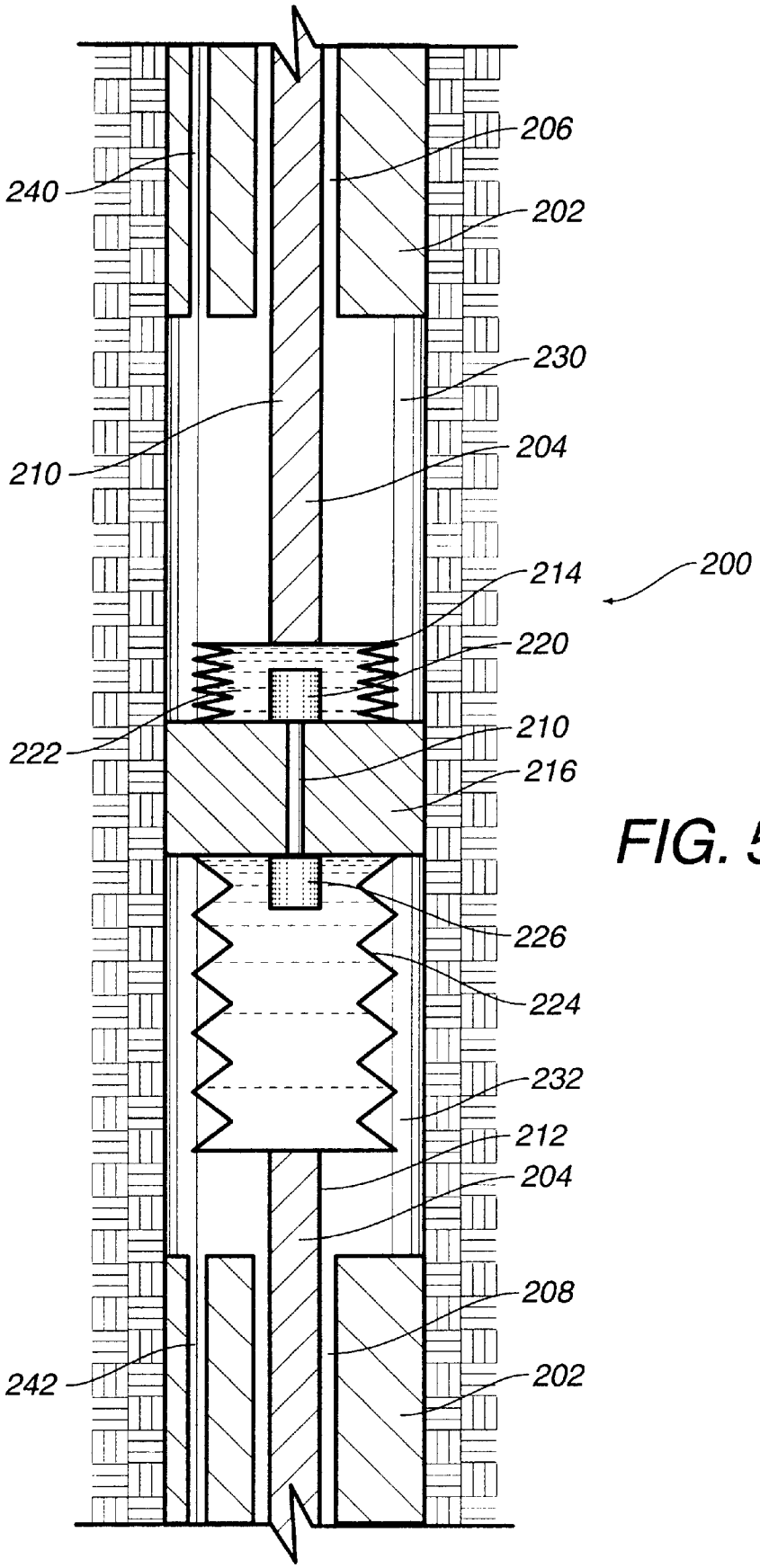
FIG. 5 is a cross-sectional view of one form of a pilot to control a valve which is used to for evacuation of the pressure and venting systems of the present invention.
Figure 6A:
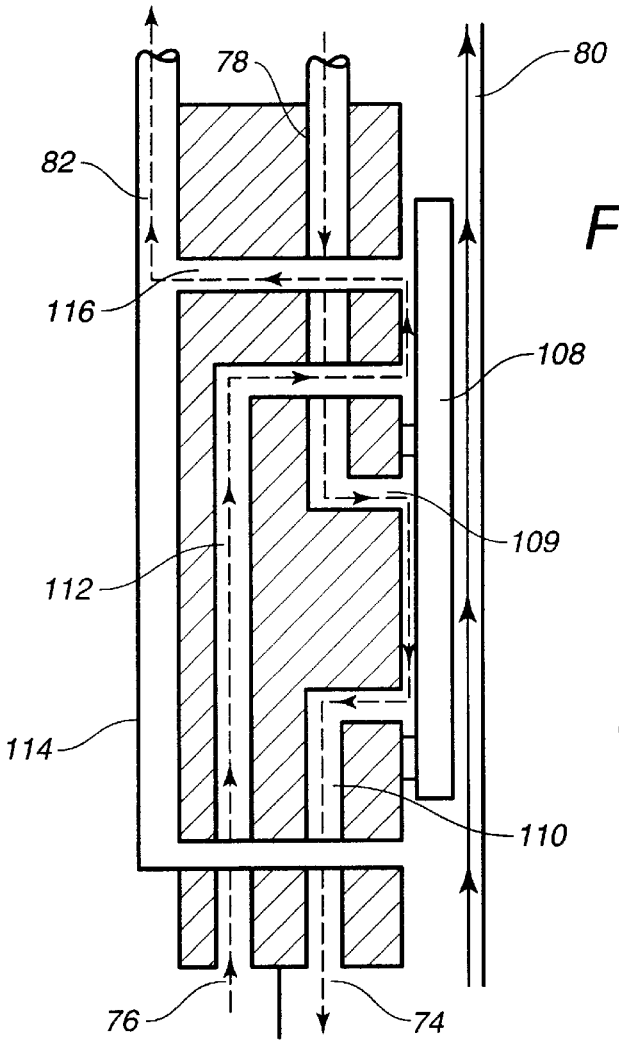
FIGS. 6A and 6B are enlarged views of the valving mechanism in different positions so as to illustrate the flow of liquid, power gas and vented gas.
Figure 6B:
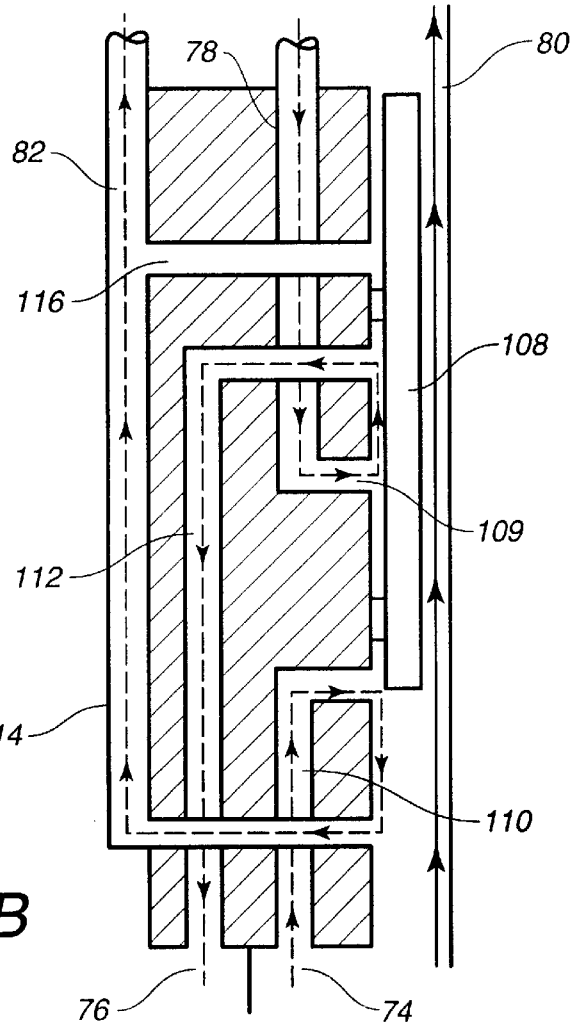

FIG. 5 shows one form of an onboard timing mechanism 200 which can serve to activate or pilot the shifting valve and thus alternate the displacement of one chamber of the dual chamber artificial lift system while the other chamber is depressurized and refilled. In FIG. 5, a portion of a valve body 202 is illustrated as having a control rod 204 extending therethrough. The control rod 204 extends through a channel 206 at one end of the valve body 202 and through a channel 208 formed at the other end of the valve body 202. The control rod 204 is made up of a first portion 210 and a second portion 212. The first portion 210 has one end affixed to a first bellows 214. The second portion 212 has one end affixed to a second bellows 224. The first bellows 214 will extend so as to be connected to a cross member 216 which has an orifice 218 extending therethrough. Cross member 216 serves to divide valve body 202 into two chambers. Chamber 230 is connected via passageway 240 to one of the chamber of the dual chamber artificial lift system chamber 232 is connected via passageway 242 to the other chamber of the dual chamber artificial lift system. As such, the pressures in chambers 230 and 232 will be identical to the pressure in the respective chamber to which they are connected. A screen 220 is positioned at one end of the orifice 218. The bellows 214 and 224 are liquid filled bellows. When the bellows 214 is compressed, in the manner shown in FIG. 5 as would occur when power gas pressure is applied to chamber 230 and vent gas pressure is applied to chamber 232, the fluid 222 on the interior of the first bellows 214 will flow through the orifice 218 and into the interior of a second bellows 224 and cause bellows 224 to extend to the position shown in FIG. 5. A screen 226 is provided at the opposite end of the orifice 218 and interior of the bellows 224. The control rod 204 will move relative to the displacement of the respective bellows 214 and 224. As such, the time required for the controller 200 to shift from one position to the other is controlled by the pressures in the first chamber 230 and the second chamber 232. It is also controlled by the viscosity of the liquid 222 in the respective bellows 214 and 224. It is further controlled by the diameter and length of the orifice 218. As such, the control rod 210 can be suitably connected to the shifting valve so as to allow for the controlled downhole operation of the shifting valve relative to the time required to displace liquids, depressure and refill the chambers of the double chamber lift system. The controller 200, as illustrated in FIG. 5, is but one form of the various types of controlling apparatus that can be used for the operation of the shifting valve. The configuration of the controller 200, as illustrated in FIG. 5, is particularly appropriate as a timing device for use with the shifting valve for the double chamber lift system illustrated in FIGS. 3 and 4. FIGS. 6A and 6B are enlarged views of the sliding valve 108 as illustrated in FIG. 3. FIG. 6A shows the sliding valve 108 in one position. FIG. 6B shows the sliding valve 108 in another position. The flow of liquid in the liquid string 80 is illustrated by a solid line. The flow of power gas from the power gas string 78 is illustrated by a broken line extending through passageways 109 and 110 to chamber 74 as shown in FIG. 6A. The flow of power gas from 109 and 112 to the chamber 76 is illustrated by a broken line in FIG. 6B. The flow of vent gas from chamber 76 through passageways 112 and 116 to the vent gas string 82 is illustrate by a dashed line in FIG. 6A. The flow of vent gas from the chamber 74 through the passageways 110 and 114 to the vent gas string 82 is illustrated by a dashed line in FIG. 6B.

The artificial lift system of the present invention is particularly useful for restoring production in depleted high condensate yield sour gas wells. In particular, this system can be applied to Smackover wells. The present invention achieves flowing bottom hole pressures of approximately 600 p.s.i. at 13,000 feet with flowing wellhead pressures of 300 p.s.i. The configuration of the present invention employs an apparatus that can withstand bottomhole temperatures of greater than 300 degrees F. The present system can handle produced gas volumes of 3,000 MCFD. The present invention can achieve the production of liquid volumes exceeding 500 barrels per day. The present invention is suitable for operating in a very "gassy" high API oil gravity environment. Since the wells in which the present invention are intended to be used for producing in sour gas environments, the present invention minimizes the downhole parts. As a result, the present invention avoids the destructive effects of the corrosive environment into which it is placed. The downhole moving parts are wireline retrievable. The present invention can work with saturated brines having greater than 200,000 parts per million chlorides. The present invention is compatible with conventionally-sized production casing. Despite the fact the present invention can be used at very deep volumes, the present invention is cost competitive with other forms of lift. It is possible that the present invention can be utilized in depths of up to 25,000 feet and can lift higher volumes of up to 2,000 barrels per day. Unlike intermittent systems, the present invention pushes an entire line of liquid through the liquid string. As such, the transit time of individual "slugs" of liquid is avoided. The liquid string continuously allows the outflow of liquid therefrom. The ability to control and utilize high gas pressures allows for the necessary "brute" force so as to deliver the continuous string of liquid from the liquid string.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An artificial lift system for use in a wellbore comprising:

a first chamber having an inlet and an outlet;

a second chamber having an inlet and an outlet;

a power gas string connected to said first and second chambers;

a liquid string connected to said outlets of said first and second chambers;

a venting means connected to said first and second chambers, said venting means for selectively allowing a gas to pass outwardly from said chamber;

a compressor means connected to said power gas string, said compressor means for passing a pressurized gas into said power gas string;

a valve means connected to said power gas string and to said first and second chambers, said valve means for selectively allowing the pressurized gas to enter said first and second chambers so as to cause any liquid in said first and second chambers to pass through the respective outlets of said first and second chambers and into said liquid string such that the liquid extends continuously along said liquid string, said valve means connecting said power gas string to said first chamber such that said valve means selectively passes the pressurized gas from said power gas string into said first chamber, said valve means connecting said power gas string to said second chamber such that said valve means selectively passes the pressurized gas from said power gas string into said second chamber, said first chamber positioned interior of said second chamber.

2. The system of claim 1, said valve means being movable between a first position in which said valve means passes the pressurized gas into said first chamber while blocking gas flow into said second chamber and a second position in which said valve means passes the pressurized gas into said second chamber while blocking gas flow into said first chamber.

3. The system of claim 2, said venting means being interactive with said valve means for venting gas from said first chamber when said valve means is in said second position and for venting gas from said second chamber when said valve means is in said first position.

4. An artificial lift system for use in a wellbore comprising:

a first chamber having an inlet and an outlet;

a second chamber having an inlet and an outlet;

a power gas string connected to said first and second chambers;

a liquid string connected to said outlets of said first and second chambers;

a venting means connected to said first and second chambers, said venting means for selectively allowing a gas to pass outwardly from said chamber;

a compressor means connected to said power gas string, said compressor means for passing a pressurized gas into said power gas string;

a valve means connected to said power gas string and to said first and second chambers, said valve means for selectively allowing the pressurized gas to enter said first and second chambers so as to cause any liquid in said first and second chambers to pass through the respective outlets of said first and second chambers and into said liquid string such that the liquid extends continuously along said liquid string, said valve means connecting said power gas string to said first chamber such that said valve means selectively passes the pressurized gas from said power gas string into said first chamber, said valve means connecting said power gas string to said second chamber such that said valve means selectively passes the pressurized gas from said power gas string into said second chamber from said power gas string into said second chamber, said first chamber being in stacked relation to said second chamber, said valve means comprising:

a valve body extending between said first chamber and said second chamber;

a control rod; and an orifice extending between said first chamber and said second chamber, said control rod having a first bellows affixed thereto and extending over said orifice, said bellows being fluid filled, said control rod having a second bellows affixed to said control rod and over an opposite end of said orifice, said second bellow being fluid filled, said control rod being movable relative to a difference in pressures acting on said first and second bellows.

5. The system of claim 4, the fluid in said first bellows passing through said orifice to said second bellows when a pressure is applied to said first bellows, the fluid in said second bellows passing to said first bellows when a pressure is applied to said second bellows.

6. A method of lifting a liquid from a wellbore comprising:

placing a first chamber into the wellbore, said first chamber having an inlet so as to allow a liquid from the wellbore to enter the first chamber;

placing a second chamber into the wellbore, said second chamber having an inlet so as to allow a liquid from the wellbore to enter the second chamber;

extending a liquid string from said first and second chambers;

extending a power gas string to said first and second chambers;

passing pressurized gas of at least 5,000 p.s.i. through said power gas string into said first chamber when a desired upper level of pressure has been reached in said power gas sting so as to force liquid from said first chamber into said liquid string without introducing pressurized gas into said liquid string;

blocking gas flow from entering said first chamber when a desired amount of liquid has entered said liquid string and when a desired lower pressure level of pressure has been reached in said power gas string, said second chamber being in valved communication with said power gas string and with said liquid string, the pressurized gas passing into said second chamber when gas flow is blocked to said first chamber such that liquid is said second chamber enters said liquid sting;

venting gas from said first and second chambers as the liquid fills said first and second chambers;

passing pressurized gas into said chambers and blocking the venting of gas so as to cause the liquid to exit said chambers and to enter the liquid string in a continuous ungasified liquid line through said liquid string.

7. The method of claim 6, further comprising:

blocking gas flow to said second chamber when pressurized gas is passed into said first chamber such that liquid from said first chamber enters said liquid string.

8. The method of claim 6, further comprising:

communicating the wellbore such that liquids from a subsurface earth formation can flow into the wellbore; and positioning said chambers so as to communicate with the perforations of the wellbore.

9. The method of claim 8, said step of venting comprising:

extending a vent stack from said chambers so as to have an outlet above the perforations.

* * * * *